US009541094B2

(12) United States Patent
Iwakiri et al.

(10) Patent No.: US 9,541,094 B2
(45) **Date of Patent: *Jan. 10, 2017**

(54) SCROLL STRUCTURE OF CENTRIFUGAL COMPRESSOR

(75) Inventors: Kenichiro Iwakiri, Tokyo (JP); Isao Tomita, Tokyo (JP); Motoki Ebisu, Tokyo (JP); Hiroshi Suzuki, Tokyo (JP); Takashi Shiraishi, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 699 days.

This patent is subject to a terminal disclaimer.

(21) Appl. No.: 13/823,607

(22) PCT Filed: Dec. 5, 2011

(86) PCT No.: PCT/JP2011/078060

§ 371 (c)(1),
(2), (4) Date: Apr. 10, 2013

(87) PCT Pub. No.: WO2012/090649

PCT Pub. Date: Jul. 5, 2012

(65) Prior Publication Data

US 2013/0266432 A1 Oct. 10, 2013

(30) Foreign Application Priority Data

Dec. 28, 2010 (JP) ..... 2010-294079

(51) Int. Cl.
*F04D 29/40* (2006.01)
*F04D 29/44* (2006.01)
*F04D 29/42* (2006.01)

(52) U.S. Cl.
CPC ..... *F04D 29/403* (2013.01); *F04D 29/4206* (2013.01); *F04D 29/441* (2013.01); *F05D 2250/52* (2013.01)

(58) Field of Classification Search
CPC .. F04D 29/403; F04D 29/4206; F04D 29/441; F05D 2250/52
See application file for complete search history.

(56) References Cited

U.S. PATENT DOCUMENTS 494,890 A 4/1893 Rateau
5,624,229 A 4/1997 Kotzur et al.
(Continued)

FOREIGN PATENT DOCUMENTS

CN 101684827 A 3/2010
EP 2 180 192 A1 4/2010
(Continued)

OTHER PUBLICATIONS

Machine translation of JP 11303796.*
(Continued)

*Primary Examiner* — Thomas Denion
*Assistant Examiner* — Brandon Lee
(74) *Attorney, Agent, or Firm* — Birch, Stewart, Kolasch & Birch, LLP

(57) ABSTRACT

A scroll structure of a centrifugal compressor 1 having a spirally formed scroll passage 13. The scroll passage 13 includes: a flat connecting portion A at a flow passage joint 23 where a scroll start and a scroll end of the scroll passage 13 meet, this flat connecting portion having a flat cross-sectional shape with a same height as that of an outlet passage of a diffuser; and a transition part 21 where the flat cross-sectional shape of the flat connecting portion A gradually changes back to a circular cross-sectional shape along a circumferential direction.

8 Claims, 6 Drawing Sheets

(56) References Cited

U.S. PATENT DOCUMENTS

| | | | | |
|---|---|---|---|---|
| 8,591,177 | B2 * | 11/2013 | Yokoyama | F01D 9/026 415/119 |
| 2006/0081226 | A1 | 4/2006 | Bolz | |
| 2010/0178163 | A1 | 7/2010 | Dettmann et al. | |

FOREIGN PATENT DOCUMENTS

| | | | | |
|---|---|---|---|---|
| JP | 156135 | | 4/1943 | |
| JP | 58-92423 | U | 6/1983 | |
| JP | 3-217699 | A | 9/1991 | |
| JP | 5-042699 | U | 6/1993 | |
| JP | 8-503284 | A | 4/1996 | |
| JP | 10-252696 | A | 9/1998 | |
| JP | 11-303796 | A | 11/1999 | |
| JP | 11303796 | A * | 11/1999 | |
| JP | 2000-64994 | A | 3/2000 | |
| JP | 2005-2951 | A | 1/2005 | |
| JP | 2006-501397 | A | 1/2006 | |
| JP | 2007-211717 | A | 8/2007 | |
| JP | WO 2010047259 | A1 * | 4/2010 | F01D 9/026 |
| JP | 4492045 | B2 | 6/2010 | |
| JP | 2010-529358 | A | 8/2010 | |
| WO | WO 95/08050 | A1 | 3/1995 | |
| WO | WO 2004/031590 | A1 | 4/2004 | |

OTHER PUBLICATIONS

Office Action effective Feb. 28, 2015 issued in the corresponding Chinese Application No. 201180046268.3 with an English translation.

International Preliminary Report on Patentability mailed on Jul. 18, 2013 issued in PCT/JP2011/078060 with an English translation.

Decision to Grant a Patent issued Jan. 7, 2014 in corresponding Japanese Application No. 2010-294079 with English Translation.

Chinese Notice of Allowance, dated Apr. 5, 2016, for Chinese Application No. 201180046268.3, with an English translation.

Chinese Office Action for Chinese Application No. 201280012280.7 dated May 25, 2015 with an English English Translation.

Decision to Grant a Patent effective Feb. 24, 2014 issued in corresponding Japanese Application No. 2011-059935 with English Translation.

Extended European Search Report for European Application No. 12757491.1 dated Nov. 13, 2014.

International Preliminary Report on Patentability mailed Sep. 26, 2013 issued in PCT/JP2012/051891 with an English Translation.

International Search Report for International Application No. PCT/JP2012/051891 with an English Translation.

Notice of Allowance effective May 3, 2016 issued in Chinese Application No. 201280012280.7 with English Translation.

* cited by examiner

SECTION WHERE $\theta$ = 90°

SECTION WHERE $\theta$ = 75°

SECTION WHERE $\theta$ = 60° (TONGUE PORTION)

SCROLL STRUCTURE OF CENTRIFUGAL COMPRESSOR

TECHNICAL FIELD

The present invention relates to a scroll structure (spiral chamber structure) of a centrifugal compressor used in turbochargers or the like of vehicles or ships.

BACKGROUND ART

Centrifugal compressors used in a compressor part or the like of turbochargers in vehicles or ships give a kinetic energy to a fluid through rotation of a vaned wheel and discharge the fluid radially outward to raise the fluid pressure by the centrifugal force.

Various improvements have been made to the scroll structure of the centrifugal compressor in response to the demands for a high pressure ratio and high efficiency in a wide operation range.

Patent Document 1 (Japanese Patent Publication No. 4492045), for example, shows one example of conventional techniques, represented by a centrifugal compressor having a casing with a spirally formed scroll passage. The width in the axial direction of the scroll passage is gradually increased radially from inside to outside, the width being maximum on the radially outer side than the radial midpoint of the passage width.

Patent Document 2 (Japanese Translation of PCT Application No. 2010-529358) relates to a centrifugal compressor for a turbocharger, the compressor having a spiral housing and a diffuser. Patent Document 2 shows that the diffuser is increased in its diameter so as to reduce the low-pressure region in a transition area of the spiral housing (scroll) or an area where the tongue exists.

Patent Document 1: Japanese Patent Publication No. 4492045

Patent Document 2: Japanese Translation of PCT Application No. 2010-529358

As shown in FIGS. 11 and 12, the scroll 13 generally has a circular cross-sectional shape as shown in FIG. 12, and the scroll start and the scroll end of the scroll 13 are connected to form a flow passage joint 04 in a tongue portion 05 shown in FIG. 11.

FIG. 11 shows a front view of a scroll compressor. FIG. 12 shows cross-sectional shapes of the scroll at angles θ1, θ2, . . . advanced by a predetermined amount Δθ clockwise from the tongue portion 05 in an overlaid representation.

In the tongue portion 05, the flow passage joint 04 has a cross-sectional shape with a circular part 09 and a diffuser part 011 contacting this circular part 09, as indicated by the hatches in FIG. 12.

Referring to FIG. 13 which shows the circumferential static pressure inside the scroll, at a high flow-rate operating point, the fluid velocity increases from the scroll start to the scroll end, and the pressure at the scroll start is higher than that of the scroll end, so that there is practically no flow recirculation from the scroll end into the scroll start in the tongue portion 05 (joint between the scroll passage and the outlet passage).

On the other hand, at a low flow-rate operating point, the fluid velocity decreases from the scroll start to the scroll end, and the pressure at the scroll start is lower than that of the scroll end, so that there occurs flow recirculation from the scroll end into the scroll start in the tongue portion. This phenomenon causes the following pressure losses inside the scroll.

(1) First is a pressure loss caused by flow separation. The fluid flows toward the discharge port of the scroll spirally along the outer circumference of the inner wall of the scroll. The flow in the boundary layer near the wall surface is sucked into the scroll start by a pressure gradient at the flow passage joint in the tongue portion, whereby flow recirculation occurs. Flow separation occurs at this time at the flow passage joint in the tongue portion, which forms a high pressure loss region.

(2) Second is a pressure loss caused by friction. The recirculating flow that has lost energy by the separation accumulates in the center of the cross section of the scroll passage. Since such flow has low pressure, it causes to increase the pressure gradient towards the center of the scroll cross section, as a result of which the velocity of the fluid flowing spirally inside the scroll passage is increased. This increases the pressure loss by friction inside the scroll passage.

It then follows that flow recirculation that occurs in the tongue portion is the major cause of pressure loss inside the scroll at a low flow-rate operating point.

Patent Document 1 discloses a technique for improving the characteristics of the spiral flow inside the scroll passage, wherein the scroll passage is formed to have a peculiar non-circular cross-sectional shape. However, it does not disclose how to minimize the amount of recirculation near the tongue portion for better machine performance. Patent Document 2 shows reducing the negative pressure region near the tongue portion, but it relates to improvement by means of a diffuser and does not disclose improvement of the scroll cross-sectional shape for better machine performance.

DISCLOSURE OF THE INVENTION

The present invention was made in view of these problems. It is an object of the invention to provide a scroll structure of a centrifugal compressor having an improved scroll cross-sectional shape near the tongue portion to minimize flow recirculation from the outlet passage of the diffuser 11 into the scroll passage 13 near the tongue portion, so as to improve the compressor performance at a low flow-rate operating point as well as the anti-surge performance.

To solve the problems described above, the present invention provides a scroll structure of a centrifugal compressor having a spirally formed scroll passage. The scroll passage includes: a flat connecting portion at a flow passage joint where a scroll start and a scroll end of the scroll passage meet, this flat connecting portion having a flat cross-sectional shape with a same height as that of an outlet passage of a diffuser; and a transition part where the flat cross-sectional shape of the flat connecting portion gradually changes back to a circular cross-sectional shape along a circumferential direction.

With this invention, the scroll start and the scroll end of the scroll passage are connected at the flow passage joint via a portion having a flat cross-sectional shape with the same height as that of the outlet passage of the diffuser, so that, as compared to the connecting portion with a circular shape of the conventional technique (see FIG. 12), the flow area is reduced, whereby the amount of recirculation can be reduced.

In the present invention, preferably, the transition part may be set to have a circumferential length that requires a fluid, which flows into the scroll passage from the diffuser outlet at the flow passage joint, to make substantially one turn around the cross section of the scroll.

As the transition part is set to have a circumferential length required for the fluid to make one turn and the circular shape is gradually regained, secondary flow losses caused by a rapid change in cross-sectional shape are prevented and the fluid flow inside the scroll passage can be made smooth.

As the circular shape is regained after the length in which the fluid makes substantially one turn, the fluid can smoothly flow in spirals along the circular shape after making the one turn.

In the present invention, preferably, the circumferential length of the transition part may be determined by a circumferential angle of substantially 30° from a line connecting a rotation center of a compressor wheel and a tongue portion located at the flow passage joint. This is because, although it depends on the fluid velocity inside the scroll passage, the fluid makes one turn around the cross section from the tongue portion substantially within the range of 30°, according to the calculation results of simulation and test results confirmed with actual machines.

In the present invention, preferably, in the transformation of the flat shape into the circular shape in the transition part, a flat portion may be provided to part of the cross-sectional shape on the downstream side, and this flat portion may be gradually decreased so that the flat shape changes into the circular shape.

As the flat shape is transformed into the circular shape wherein the flat portion is partly maintained but reduced, there is no rapid change in the cross-sectional shape and the transformation into the circular shape is smooth, so that secondary flow losses are prevented and a smooth spiral flow is achieved.

In the present invention, preferably, the flat shape may change into a circular shape in the transition part such that while one surface of the flat shape having a same height as that of the diffuser is matched with one surface in a height direction of the diffuser, the other surface opposite a direction of fluid flowing out of a diffuser outlet is formed in a circular arc shape, and this circular arc surface may be gradually enlarged so that the circular shape is regained.

The circular arc shape may have a circular arc center located at an end of the diffuser outlet, or at the center of the scroll passage. Alternatively, the circular arc center may be located on a line at a same height as that of the outlet passage of the diffuser and progressively closer to an end of the diffuser outlet as the cross-sectional shape becomes progressively circular.

The surface opposite the direction of fluid flowing out of the diffuser outlet is formed in a circular arc shape, and this circular arc surface is gradually enlarged so that the circular shape is regained. The flow coming out of the diffuser outlet does not exist all across the cross section of the scroll at the scroll start but flows closer to the outer circumference of the scroll. Therefore, by forming a cross-sectional shape in accordance with this biased flow, the cross-sectional shape can be made to conform with the fluid flow from the diffuser outlet, and can be transformed more smoothly into the circular shape. A smooth transformation of the cross-sectional shape, whereby secondary flow losses are prevented, can thus be achieved.

By setting the circular arc center to be located not at one end of the diffuser outlet but at the center of the scroll passage, or at varying positions on the line at the same height as that of the outlet passage of the diffuser, the apparent length of the diffuser can be made longer near the tongue portion of the scroll passage, whereby the pressure can be raised near the tongue portion. As a result, the circumferential static pressure distribution can be made more uniform.

According to the invention, in a scroll structure of a centrifugal compressor having a spirally formed scroll passage, the scroll passage includes a flat connecting portion at a flow passage joint where a scroll start and a scroll end of the scroll passage meet, the flat connecting portion having a flat cross-sectional shape with a same height as that of an outlet passage of a diffuser, and a transition part where the flat cross-sectional shape of the flat connecting portion gradually changes back to a circular cross-sectional shape along a circumferential direction. As the scroll start and the scroll end of the scroll passage are connected at the flow passage joint via a portion having a flat cross-sectional shape with the same height as that of the outlet passage of the diffuser, the flow area is reduced as compared to the connecting portion with a circular shape of the conventional technique (see FIG. 12), whereby the amount of recirculation can be reduced, and the scroll structure of the centrifugal compressor with improved compressor performance at a low flow-rate operating point can thus be provided. An uneven pressure distribution at the diffuser outlet leads to an uneven flow rate distribution at the inlet of the vaned wheel, as a result of which the vaned wheel may stall, or go into surge. The present invention provides a scroll structure of a centrifugal compressor with improved anti-surge performance by making the circumferential static pressure distribution uniform.

Furthermore, as the amount of recirculation is reduced, there is no need to allow for the extra amount of flow that will recirculate, as a consequence of which a smaller, more lightweight scroll structure of a centrifugal compressor with a reduced cross-sectional area of the scroll can be provided.

BEST MODE FOR CARRYING OUT THE INVENTION

The illustrated embodiments of the present invention will be hereinafter described in detail.

It should be noted that, unless otherwise specified, the size, material, shape, and relative arrangement or the like of constituent components described in these embodiments are only illustrative examples and not intended to limit the scope of this invention.

(First Embodiment)

Figure 1:
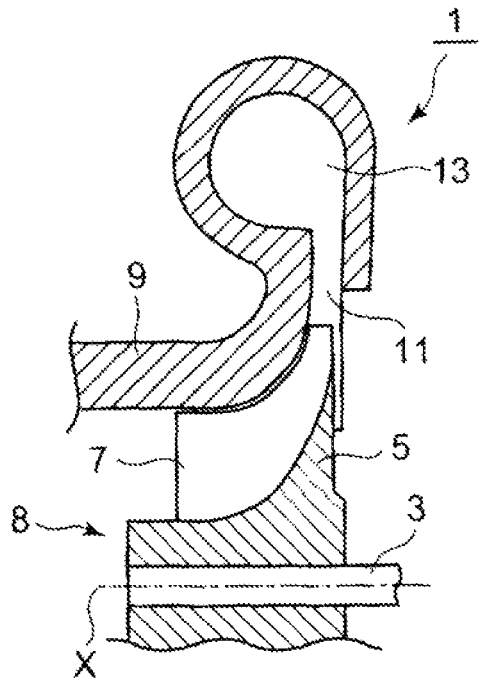
FIG. 1 is a schematic overall view of a centrifugal compressor in one embodiment of the present invention.

FIG. 1 shows a schematic cross-sectional view of a centrifugal compressor 1 of the present invention. The centrifugal compressor 1 shown in this embodiment is applied to a turbocharger. A plurality of compressor blades 7 are formed on the surface of a hub 5 secured to a rotating shaft 3 driven by a turbine (not shown), with a compressor housing 9 covering the outside of the compressor blades 7. A diffuser 11 is formed on the radially outer side of the compressor blades 7, and a scroll passage 13 is formed around this diffuser 11.

Figure 2:
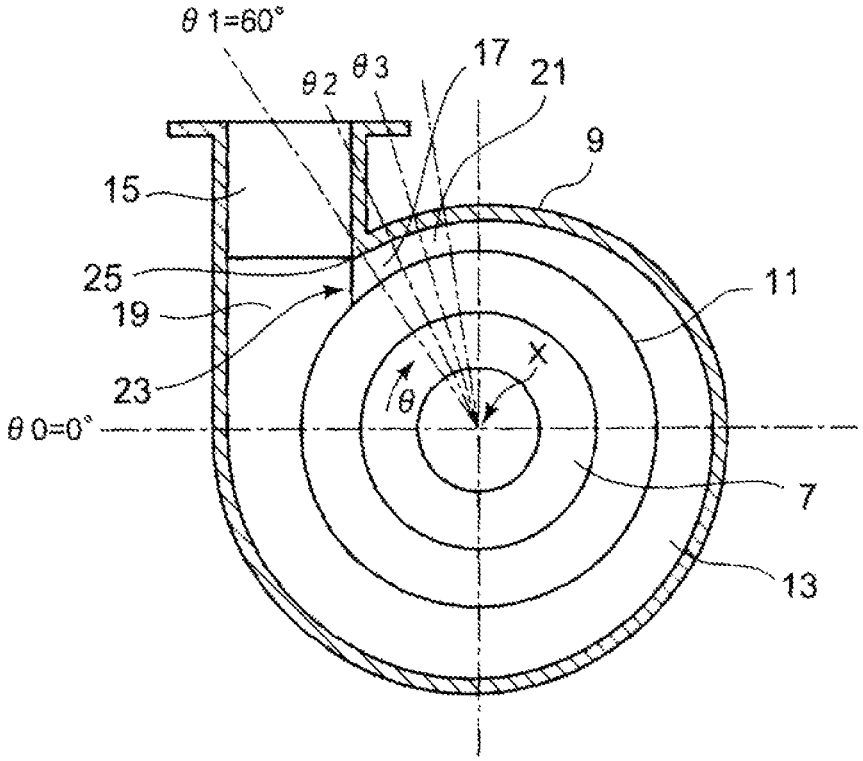
FIG. 2 is a cross-sectional view of the centrifugal compressor of the embodiment.

FIG. 2 shows a cross section of the scroll passage 13. The compressor housing 9 includes the scroll passage 13 and a linear outlet passage 15 that communicates with the scroll passage 13. The cross-sectional area of the scroll passage 13 increases with an increase in spiral angle θ clockwise in FIG. 2 from the scroll start 17, and with spiral angle θ□□ exceeding 360°, the scroll reaches a scroll end 19. The scroll passage 13 has a transition part 21 where the cross-sectional shape of the scroll passage 13 changes from flat to circular. This transition part 21 will be described later.

In this embodiment, the spiral angle θ, between the horizontal position (θ=0) as shown in FIG. 2 and the line connecting the position of a tongue portion 25 at the flow passage joint 23 where the scroll start and the scroll end of the scroll passage meet and the center X of the compressor wheel 8, is substantially 60°.

Next, the cross-sectional shape of the scroll passage 13 will be explained.

Figure 3:
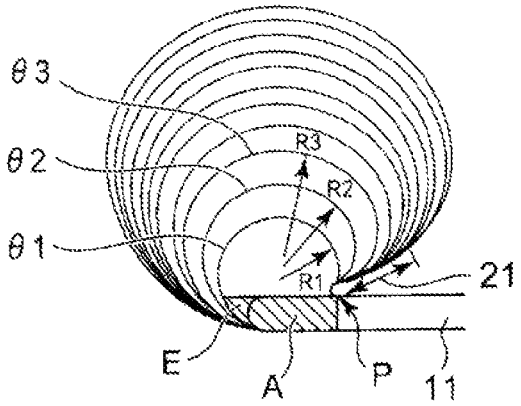
FIG. 3 is a diagram for explaining the changes in the cross-sectional shape of the scroll in a first embodiment.

As shown in FIG. 3, the flow passage joint 23 where the scroll start and the scroll end of the scroll passage 13 meet is formed as a flat connecting portion A having a flat cross-sectional shape with the same height as that of the outlet passage of the diffuser 11.

Figure 9:
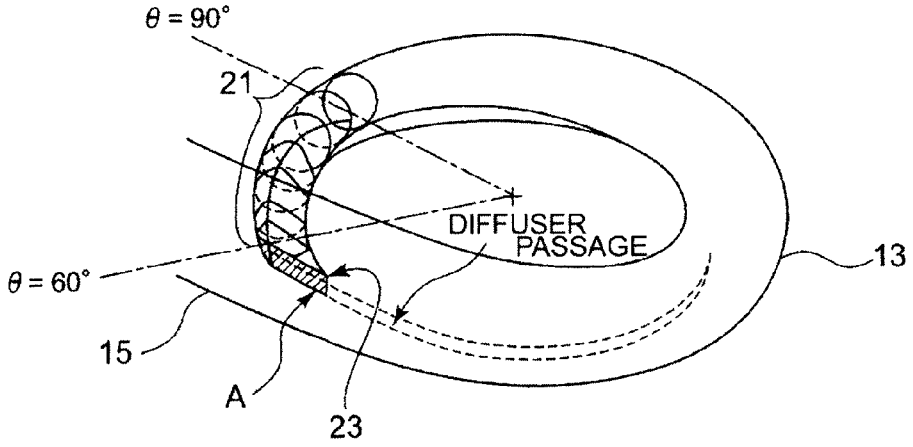
FIG. 9 is a schematic view for explaining how the cross-sectional shape changes near the flow passage joint.
Figure 10:
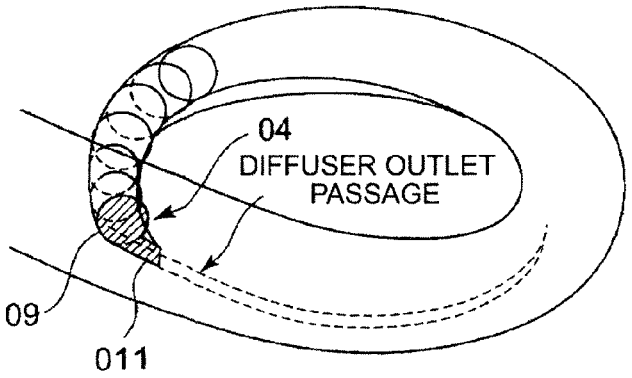
FIG.10 PRIOR ART
FIG. 10 is a diagram for explaining a conventional technique corresponding to FIG. 9.
Figure 11:
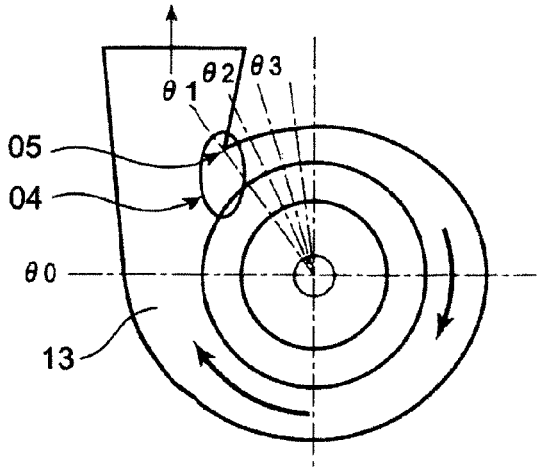
FIG.11 PRIOR ART
FIG. 11 is a diagram for explaining a conventional technique.

This flat connecting portion A at the flow passage joint 23 is formed flat with the same height as that of the outlet passage of the diffuser 11, as shown schematically in FIG. 9. This flat cross-sectional shape changes gradually to a circular shape with an increase in the spiral angle θ. The cross section returns to circular generally by the point where θ=90°. This area in which the cross-sectional shape returns from flat to circular is referred to as the transition part 21 of the scroll passage 13.

Too long a transition part 21 will take up too large an area before the cross section becomes circular again and will affect the compressor performance. The cross-sectional shape needs to be returned to circular at least somewhere between θ=90° to 180°.

The transition part 21, which is the area between θ=60° where the scroll starts to around a point where θ=90°, is set to have a length for the fluid flowing out from the diffuser 11 to the scroll start 17 to flow more or less one turn around the cross section of the scroll passage 13, so that the fluid flows smoothly in spirals after the one turn along the circular cross-sectional shape. The cross section is circular at any angular position past the transition part 21 all the way to the scroll end 19 of the scroll passage.

The flow inside the scroll includes a main flow that flows in the circumferential direction toward the scroll outlet, and a spiral flow that flows spirally along the main flow inside the scroll passage. Therefore, it is natural and necessary to return the flow flowing out from the diffuser 11 to the scroll start 17 back to the spiral flow along the circular shape.

The flow does not exist all across the cross section of the scroll near the flow passage joint 23 since the flow exiting from the diffuser 11 flows closer to the outer circumference of the scroll. The transition part has a length corresponding to a distance for the fluid to make substantially one turn, as it is necessary for the fluid to flow smoothly in spirals along the circular cross-sectional shape after the span of substantially one turn around the cross section of the scroll.

Figure 8A:
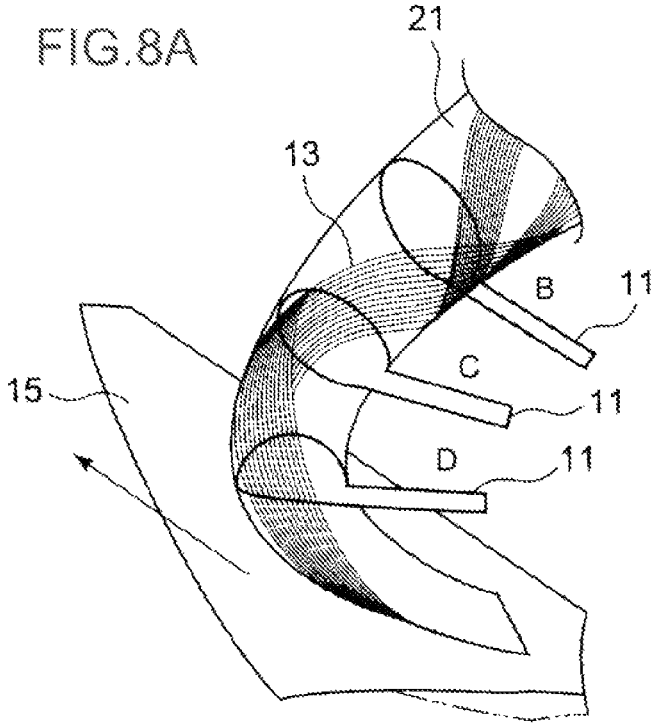
FIG. 8A to FIG. 8D are diagrams showing streamlines of fluid inside the scroll passage for explaining how the fluid flows spirally near a tongue portion, FIG. 8A illustrating the overall view, FIG. 8B illustrating the point where the spiral angle θ is 90°, FIG. 8C illustrating the point where the spiral angle θ is 75°, and FIG. 8D illustrating the point where the spiral angle θ is 60° (tongue portion)

Now the fluid makes one spiral turn will be described with reference to FIG. 8. FIG. 8A illustrates the streamlines of the flow exiting from the diffuser 11 near the flow passage joint 23 determined based on the calculation results of simulation.

Figure 8B:
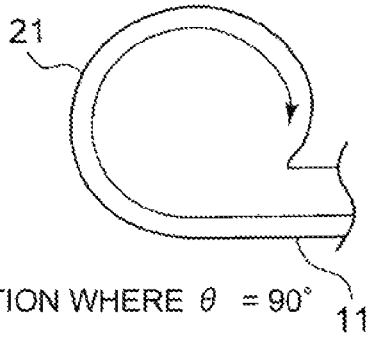
Figure 8C:
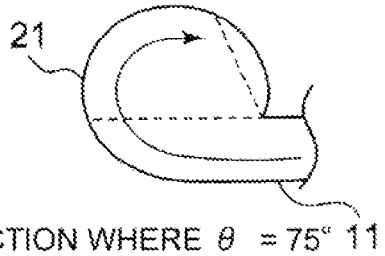
Figure 8D:
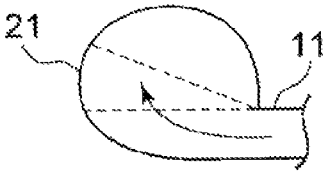

FIG. 8D shows a streamline at the tongue position where the spiral angle θ is about 60°, indicating a state where a spiral flow starts closer to the outer circumference of the scroll.

FIG. 8C shows a streamline at the point where the spiral angle θ is 75°, where the fluid has advanced further along the outer circumference of the scroll almost halfway through the spiral turn inside the scroll.

FIG. 8B in the drawing shows a streamline at the point where the spiral angle θ is 90°, where the fluid has advanced even further along the outer circumference of the scroll almost all around the spiral turn.

As these streamlines determined based on the calculation results of simulation indicate, the fluid turns almost all around the cross section of the scroll by the time it reaches a point where the spiral angle θ is about 90°. The amount of spiral flow and spiral speed may vary depending on the operating conditions, but it can be seen that it will be appropriate for the scroll to have a circular cross section again at the point where the spiral angle is about 90°, i.e., within a circumferential range of about 30° from the tongue portion 25.

FIG. 3 shows how the cross-sectional shape of the transition part 21 formed to the scroll passage 13 is returned to a necessary circular shape and how the cross-sectional shape of the scroll passage 13 changes after the transition part 21.

As FIG. 3 shows, the flat connecting portion A having a matching height with the diffuser 11 is formed to have a distal end edge E at the tip conforming to the outer wall, but the distal end edge may be formed with a curvature. Forming the distal end edge with a curvature will prevent local separation or generation of turbulence around the edge (the same applies to other embodiments).

While one flat surface of the flat connecting portion A is matched with one surface in the height direction of the diffuser 11, the other surface is changed such that the diameter of the circular arc is gradually increased so that the necessary circular shape is regained.

More specifically, the passage has the flat connecting portion A at the position of the tongue 25 in FIG. 2, where the spiral angle (circumferential angle) θ0 is 60°. At the point where the angle has advanced from θ0 by a certain amount Δθ to θ1, the cross section is circular with a radius of R1. At the point where the angle has advanced by a certain amount Δθ to □θ2, the cross section is circular with a radius of R2. Further, at the point where the angle has advanced by a certain amount Δθ to □□θ3, the cross section is circular with a radius of R3. The cross section changes gradually to circular shapes of respective sizes in this manner. After the transition part 21 where the cross section has regained its necessary circular shape, it remains circular all the way to the scroll end 19 of the scroll passage.

Figure 12:
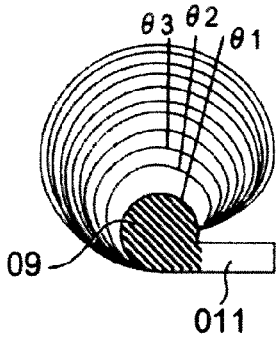
FIG.12 PRIOR ART
FIG. 12 is a diagram for explaining a conventional technique.

As described above, in the first embodiment, the scroll start and the scroll end of the scroll passage 13 are connected at the flow passage joint 23 via the flat connecting portion A having a cross-sectional shape with the same height as that of the outlet passage of the diffuser 11, so that, as compared to the connecting portion with a circular shape of the conventional technique (see FIG. 12), the flow area is reduced, whereby the amount of fluid flowing back in to recirculate can be reduced.

The transition part 21 is set to have a circumferential length required for the fluid flowing from the diffuser outlet at the flow passage joint 23 into the flow passage to make substantially one turn around the cross section so that the circular shape is gradually regained, whereby secondary flow losses caused by a rapid change in cross-sectional shape are prevented and the fluid flow inside the scroll passage can be made smooth.

As the circular shape is regained after the length in which the fluid makes substantially one turn, the fluid can smoothly flow in spirals along the circular shape after making one turn.

(Second Embodiment)

Next, a second embodiment will be described with reference to FIG. 4.

Figure 4:
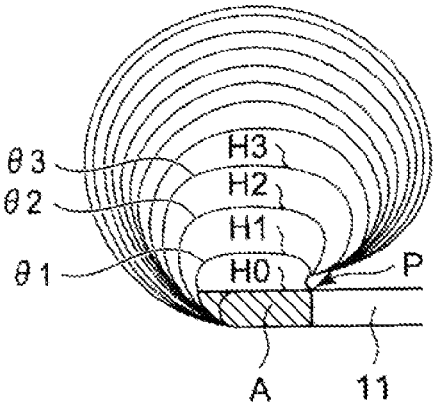
FIG. 4 is a diagram for explaining the changes in the cross-sectional shape of the scroll in a second embodiment.

The characteristic feature here is that in the transformation of the cross-sectional shape of the flat connecting portion A into the circular shape at the transition part 21, a flat portion H is provided to part of the cross-sectional shape on the downstream side as shown in FIG. 4, this flat portion H gradually decreasing in the transformation into the circular shape.

In the first embodiment described above, the flat shape of the flat connecting portion A changes immediately into a small circular shape, after which the diameter of the circular shape increases gradually from R1. In the second embodiment, the flat portion H is provided in this transformation, wherein the flat portion H is decreased so that the shape gradually becomes circular.

More specifically, the passage has the flat connecting portion A at the position of the tongue 25 in FIG. 4, where the spiral angle θ0 is 60°, with a flat portion H0. At the point where the angle has advanced from θ0 by a certain amount Δθ to θ1, the cross section has a flat portion H1. At the point where the angle has advanced by a certain amount Δθ to θ2, the cross section has a flat portion H2. Further, at the point where the angle has advanced by a certain amount Δθ to θ3, the cross section has a flat portion H3. The cross section thus changes to a circular shape of a predetermined size as the flat portion gradually decreases.

While one flat surface of the flat connecting portion A is matched with one surface in the height direction of the diffuser 11 as shown in FIG. 4, the height of the flat portion H on the other side is increased, and the width is decreased, into a circular arc and further into the circular shape.

As the flat connecting portion A includes the flat portion H as one part and changes into the circular shape, it can smoothly regain the circular cross section without a rapid change in cross-sectional shape, whereby separation caused by a rapid change in cross-sectional shape is prevented and the fluid flow inside the scroll passage 13 can be made smooth.

(Third Embodiment)

Next, a third embodiment will be described with reference to FIG. 5.

In the first embodiment described above, the cross-sectional shape was gradually enlarged from a small circle, and in the second embodiment, the cross-sectional shape was gradually enlarged from a flat shape. In the third embodiment, the shape is changed in accordance with, or in conformity with the flow coming out of the diffuser 11 near the flow passage joint 23.

Near the flow passage joint 23, the flow coming out of the diffuser 11 does not exist all across the cross section of the scroll but flows closer to the outer circumference of the scroll in a spiraling motion inside the scroll.

Therefore, in the transition part 21, the flat shape of the flat connecting portion A is changed into a circular shape such that, while one flat surface of the flat shape having the same height as that of the diffuser 11 is matched with one surface in the height direction of the diffuser, the other surface opposite the diffuser outlet is formed in a circular arc shape, and this circular arc surface is gradually enlarged so that the circular shape is regained.

Figure 5:
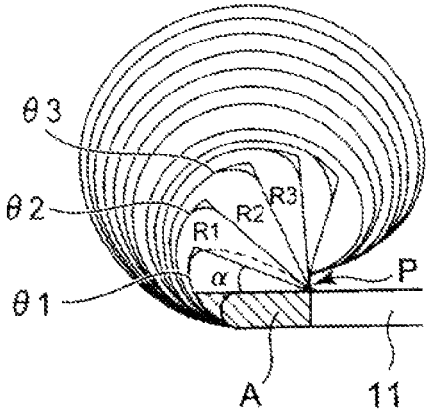
FIG. 5 is a diagram for explaining the changes in the cross-sectional shape of the scroll in a third embodiment.

More specifically, the passage has the flat connecting portion A at the position of the tongue 25 in FIG. 5, where the spiral angle θ0 is 60°. At θ1 where the angle θ0 has advanced a certain amount Δθ, the circular arc shape has a radius of R1, with the center being located at one outlet end P of the height surface of the diffuser 11. At θ2 where the angle has advanced a certain amount Δθ, the circular arc shape has a radius of R2. At θ3 where the angle has advanced a certain amount Δθ, the circular arc shape has a radius of R3.

The circular arc angle α is set such that it is increased approximately to 180° within the transition part 21 of the scroll passage 13. Radius R1, R2, or R3 may not necessarily be linear, but may be formed in a circular arc shape (as indicated by the dotted line) in consideration of the fluid flow.

Also, the respective radial lines and circular arcs may join with each other via rounded corners with an appropriate curvature so as to avoid any rapid change in the shape.

As has been described with reference to FIG. 8, the flow coming out of the diffuser 11 near the flow passage joint 23 flows progressively closer to the outer circumference of the scroll as it flows spirally. Therefore, the circular arc shape is gradually enlarged into the circular shape so as to conform to this flow. As the shape transformation is thus made in accordance with the flow coming out of the diffuser 11 near the flow passage joint 23, the cross-sectional shape is changed efficiently and returned smoothly back to circular.

As a result, secondary flow losses caused by a rapid change in cross-sectional shape are prevented, and the flow inside the scroll passage 13 can be made smooth.

(Fourth Embodiment)

Next, a fourth embodiment will be described with reference to FIG. 6.

In the third embodiment, the circular arc shape had a circular arc center located at one end of the outlet P in the height surface of the diffuser 11. The fourth embodiment is different in that the circular arc center is located at the center Q of the flat shape of the flat connecting portion A, and is otherwise the same as the third embodiment.

Figure 6:
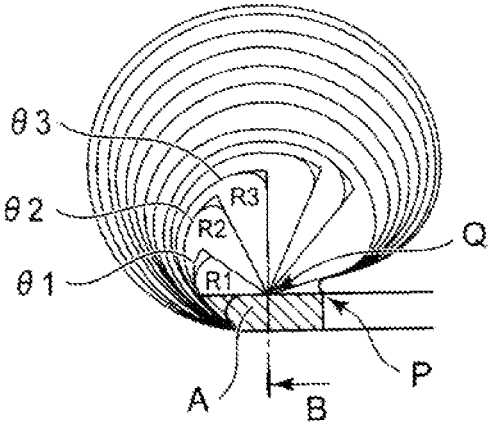
FIG. 6 is a diagram for explaining the changes in the cross-sectional shape of the scroll in a fourth embodiment.

More specifically, the passage has the flat connecting portion A at the position of the tongue 25 in FIG. 6, where the spiral angle θ0 is 60°. At θ1 where the angle θ0 has advanced a certain amount Δθ, the circular arc shape has a circular arc center located at the center Q of the flat shape, this being the starting point of the radius R1. At θ2 where the angle has advanced a certain amount Δθ, the circular arc shape has a radius of R2. At θ3 where the angle has advanced a certain amount Δθ, the circular arc shape has a radius of R3.

Radius R1, R2, or R3 may not necessarily be linear, but may be formed in a circular arc shape (as indicated by the dotted line in FIG. 5) in consideration of the fluid flow.

Also, the respective radial lines and circular arcs may join with each other via rounded corners with an appropriate curvature so as to avoid any rapid change in the shape.

As the center point that is the starting point of the radius is located not at one end P of the outlet of the diffuser 11 as in the third embodiment but at the center Q of the flat shape of the flat connecting portion A on the line at the same height as that of the outlet passage of the diffuser 11, the apparent length of the diffuser 11 can be made longer (as indicated by B in FIG. 6) near the tongue portion 25 of the scroll passage 13, whereby the pressure can be raised at the scroll start 17. As a result, the circumferential static pressure distribution can be made more uniform.

Figure 13:
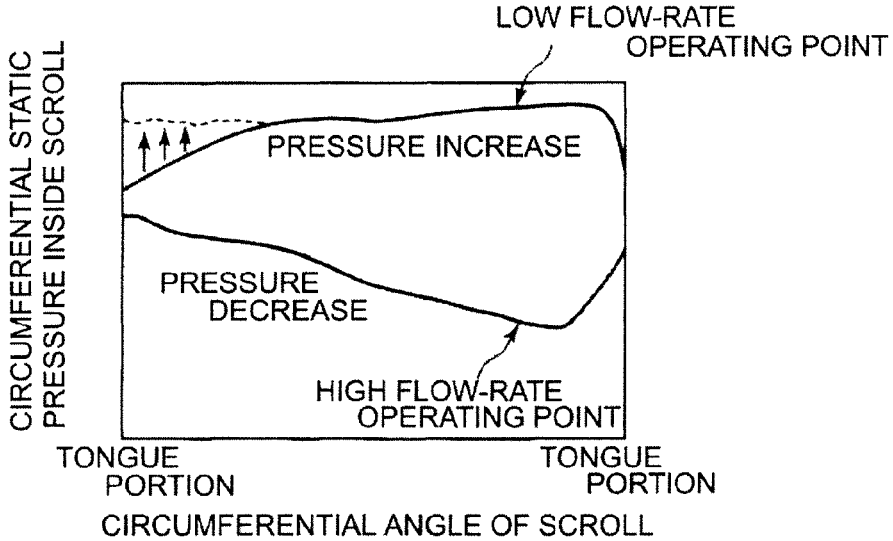
FIG. 13 is a chart showing the static pressure distribution in the circumferential direction of the scroll.

Namely, as shown in FIG. 13, the fluid velocity reduces from the scroll start toward the scroll end at a low flow-rate operating point. As the pressure at the scroll start becomes lower than the pressure at the scroll end, flow recirculation occurs from the scroll end 19 into the scroll start 17, causing a loss inside the scroll. Such a pressure difference is reduced to minimize flow recirculation, so that an improvement in the impeller performance can be expected.

Further, this uniformization of the circumferential static pressure distribution works synergistically with the effect of reducing the amount of recirculation provided by the flat shape of the flat connecting portion A of the scroll passage 13 to improve the impeller performance.

(Fifth Embodiment)

Next, a fifth embodiment will be described with reference to FIG. 7.

The fifth embodiment is characteristic in that the circular arc center location is changed, as compared to the fourth embodiment in which the circular arc center of the circular arc shape is located fixedly at the center Q of the flat shape of the diffuser 11, and is otherwise configured the same as the fourth embodiment.

Figure 7:
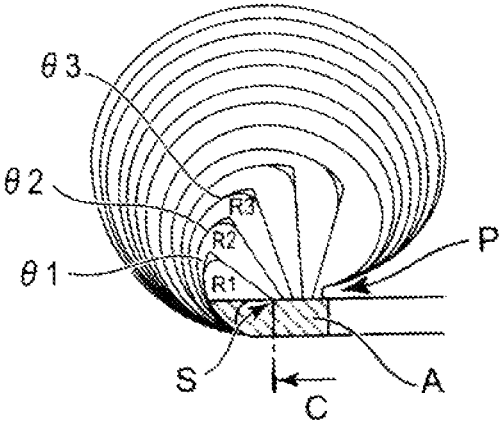
FIG. 7 is a diagram for explaining the changes in the cross-sectional shape of the scroll in a fifth embodiment.

As shown in FIG. 7, the passage has the flat connecting portion A at the position of the tongue 25, where the spiral angle θ0 is 60°. At □θ1 where the angle θ0 has advanced a certain amount Δθ, the circular arc center S of the circular arc shape has changed to another position on the upper surface of the flat shape. The circular arc center is located progressively closer to one end of the diffuser outlet as the cross-sectional shape becomes progressively circular.

Radius R1, R2, or R3 may not necessarily be linear, but may be formed in a circular arc shape (as indicated by the dotted line in FIG. 5) in consideration of the fluid flow.

Also, the respective radial lines and circular arcs may join with each other via rounded corners with an appropriate curvature so as to avoid any rapid change in the shape.

As the circular arc center S, which is the starting point of the radius, is located on the line at the same height as that of the outlet passage of the diffuser 11 in the fourth embodiment and progressively closer to one end of the diffuser outlet as the cross-sectional shape becomes progressively circular, the machining process is made easier as there is less restriction on the center position of the circular arc shape. Also, as with the fourth embodiment described above, the apparent length of the diffuser can be made longer (as indicated by C in FIG. 7) near the tongue portion 25 of the scroll passage 13, whereby the pressure can be raised at the scroll start 17. As a result, the circumferential static pressure distribution can be made more uniform by the increase in pressure (part D) at the scroll start 17 as shown in FIG. 13, which will reduce turbulence in the flow inside the scroll.

It is preferable, in the first to fifth embodiments, too, to connect the corner of one end P of the outlet of the diffuser 11 with the scroll passage 13 via a rounded joint with an appropriate curvature.

The joint between the corner of the outlet end P of the diffuser 11 and the scroll passage 13 should preferably be not just rounded but tangential to the original diffuser outlet shape.

The present invention provides an improvement in the scroll cross-sectional shape near the tongue portion to minimize flow recirculation from the outlet passage into the scroll passage near the tongue portion, whereby the compressor performance at a low flow-rate operating point, as well as the anti-surge performance, can be improved. The present invention is therefore suitable for turbochargers, centrifugal fans, blowers, etc, and also for fluid machines having a discharge scroll (spiral chamber).

The invention claimed is:

1. A centrifugal compressor comprising:

a compressor blade;

a diffuser disposed on a radially outer side of the compressor blade;

an outlet passage; and a scroll passage formed spirally around the diffuser, said scroll passage including:

a connecting portion disposed at a flow passage joint where a scroll start and a scroll end of the scroll passage meet, the connecting portion having a flat-sided cross-sectional shape with a same height as that of the outlet passage of the diffuser; and the scroll passage further comprising a transition part disposed on a downstream side of the flat-sided connecting portion, the transition part having a cross-sectional shape which gradually changes, along a circumferential direction of the centrifugal compressor, from the flat-sided cross-sectional shape of the connecting portion to a circular cross-sectional shape.

2. The centrifugal compressor according to claim 1, wherein said transition part has a circumferential length equal to the length required for a fluid which flows into the scroll passage from a diffuser outlet at said flow passage joint to make one spiral turn around the cross section of the scroll passage.

3. The centrifugal compressor according to claim 2, the compressor comprising:

a compressor wheel including the compressor blade; and a compressor housing including a tongue portion disposed at said flow passage joint, wherein said transition part of said scroll passage extends circumferentially downstream from the tongue portion for a circumferential angle of 30° .

4. The centrifugal compressor according to claim 1, wherein the cross-sectional shape of the transition part changes from said a flat-sided cross section gradually along the circumferential direction of the centrifugal compressor and becomes a circular cross-sectional shape at the end of the transition part.

5. The centrifugal compressor according to claim 1, wherein the cross-sectional shape of the transition part has a contour including an arc-contour portion which is disposed to face a fluid flow from the outlet passage of the diffuser, and said arc-contour portion is gradually enlarged along the circumferential direction so that a cross-sectional shape of the scroll passage becomes a circular cross-sectional shape formed by the enlarged arc-contour portion at an end of the transition part.

6. The centrifugal compressor according to claim 5, wherein the arc-contour portion has a circular arc center located at an end of the outlet passage of the diffuser outlet.

7. The centrifugal compressor according to claim 5, wherein the arc-contour portion has a circular arc center located at a center position of the scroll passage.

8. The centrifugal compressor according to claim 5, wherein the arc-contour portion has a circular arc center which moves closer to an end of the outlet passage of the diffuser as the cross-sectional shape of the transition part changes from the flat-sided cross-sectional shape to the circular cross-sectional shape along the circumferential direction.

* * * * *